US011060310B2

(12) United States Patent
Greer et al.

(10) Patent No.: US 11,060,310 B2
(45) Date of Patent: Jul. 13, 2021

(54) SPA COVER

(71) Applicants: Jerry Greer, San Clemente, CA (US); Jeff Coles, San Diego, CA (US); Justin Jobe, Tijuana (MX)

(72) Inventors: Jerry Greer, San Clemente, CA (US); Jeff Coles, San Diego, CA (US); Justin Jobe, Tijuana (MX)

(73) Assignee: Roberts Manufacturing LLC, San Diego, CA (US)

( * ) Notice: Subject to any disclaimer, the term of this patent is extended or adjusted under 35 U.S.C. 154(b) by 5 days.

(21) Appl. No.: 16/798,268

(22) Filed: Feb. 21, 2020

(65) Prior Publication Data

US 2020/0270887 A1 Aug. 27, 2020

Related U.S. Application Data

(60) Provisional application No. 62/808,324, filed on Feb. 21, 2019, provisional application No. 62/808,323, filed on Feb. 21, 2019.

(51) Int. Cl.
*E04H 4/08* (2006.01)

(52) U.S. Cl.
CPC ..... *E04H 4/082* (2013.01)

(58) Field of Classification Search
CPC ..... E04H 4/082; E04H 4/08; E04H 4/086; E04H 4/088
USPC ..... 4/498
See application file for complete search history.

(56) References Cited

U.S. PATENT DOCUMENTS

| | | | | |
|---|---|---|---|---|
| 5,086,525 | A * | 2/1992 | Christopher | E04H 4/08 4/498 |
| 5,367,722 | A * | 11/1994 | Pesterfield | E04H 4/08 4/499 |
| 2005/0086731 | A1* | 4/2005 | Scott | E04H 4/08 4/498 |
| 2008/0034491 | A1* | 2/2008 | Scott | E04H 4/08 4/498 |
| 2015/0047116 | A1* | 2/2015 | Brady | E04H 4/082 4/498 |
| 2020/0141145 | A1* | 5/2020 | Elliott | E04H 4/08 |

* cited by examiner

*Primary Examiner* — Huyen D Le
(74) *Attorney, Agent, or Firm* — Mitchell Law PLLC; Matthew W. Mitchell

(57) ABSTRACT

A spa cover is disclosed. The spa cover includes two separate and symmetrical halves comprising an insulating portion, a half hourglass-shaped insulating gasket, a resilient thermal gasket, and a tapered gasket spanning a bottom surface thereof and a sheet covering both halves. The two separate and symmetrical halves are joined by a hinge, which may be part of the sheet.

18 Claims, 8 Drawing Sheets

SPA COVER

CROSS REFERENCE TO RELATED APPLICATIONS

This application claims the benefit of U.S. Provisional Patent Applications Nos. 62/808,323 and 62/808,324, both filed Feb. 21, 2019, and incorporated herein by reference in their entirety.

TECHNICAL FIELD

This disclosure relates to spas, and more particularly to covers for covering a hot tub or spa when not in use.

BACKGROUND

The statements in this section merely provide background information related to the present disclosure and may not constitute prior art.

Spa covers are widely used to cover spas or hot tubs to protect the water within the spa tub from debris and to retain moisture and thermal energy within the spa. Known spa covers are available in various sizes and shapes and are designed to rest upon the top edge of a spa tub. Spa covers are often made up of two connected, folding halves and a hinge line provided on the top surface connecting the two halves. The hinge line allows the spa cover to be folded and/or removed more easily.

Generally, when not in use, the cover is secured includes a clip or a strap that secures the cover in place. This keeps the cover down from wind and weather events and helps prevent debris from polluting the water.

Unfortunately, the hinge line also enables heat and moisture loss through gaps between the halves at the hinge line. Unfortunately, known clips, buckles and straps have become untied, which creates liability for weather adverse events and water pollution. With respect to children's safety, untied covers create potential hazardous situations.

Accordingly, a need exists for an improved spa buckle, and a need exists for an improved spa cover with reduced heat and moisture loss across the hinge line.

SUMMARY

A spa cover is disclosed. The spa cover includes two separate and symmetrical halves comprising an insulating portion, a half hourglass-shaped insulating gasket, a resilient thermal gasket, and a tapered gasket spanning a bottom surface thereof and a sheet covering both halves. The two separate and symmetrical halves are joined by a hinge, which may be part of the sheet, in one embodiment.

A buckle is also disclosed that may be used in conjunction with the spa cover. The buckle includes a proximity detection sensor, and a transceiver configured to broadcast information corresponding to disconnection of the buckle.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
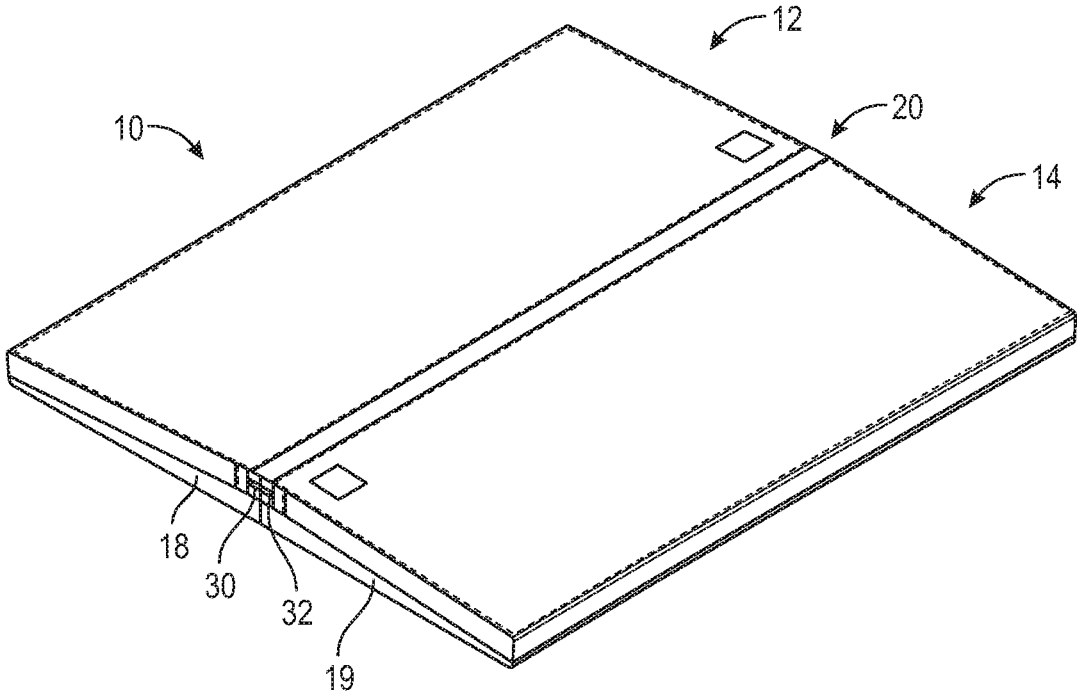
FIG. 1 shows an exemplary spa cover, in accordance with the present disclosure.
Figure 2:
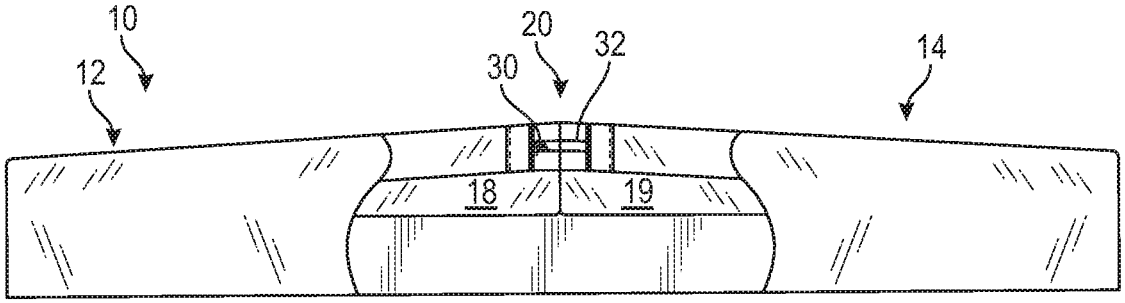
FIG. 2 is a partial sectional view showing the spa cover, in accordance with the present disclosure.
Figure 3:
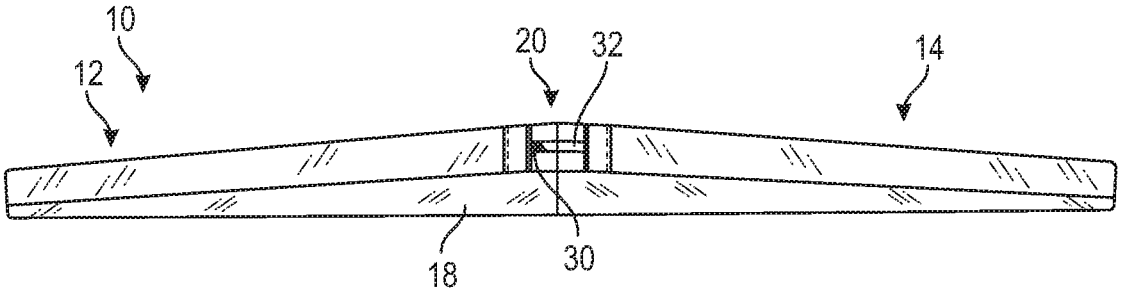
FIG. 3 shows the spa cover without an exterior sheet, in accordance with the present disclosure.
Figure 4:
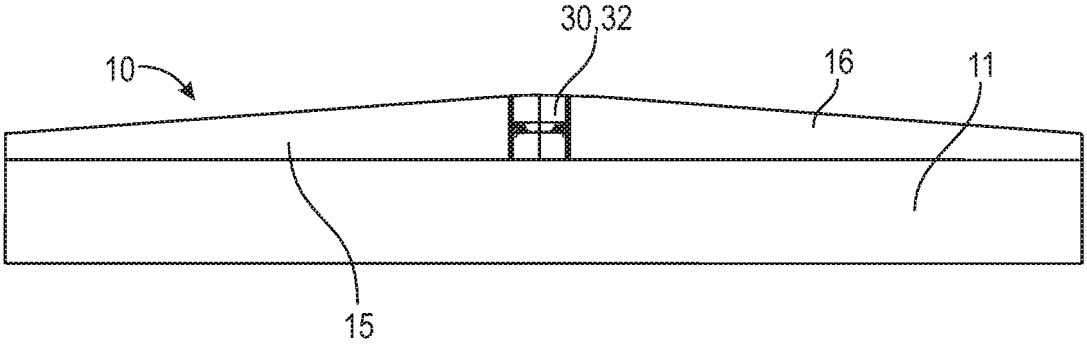
FIG. 4 is another partial section view illustrating an exemplary proportion of the skirt to insulating portions, in accordance with the present disclosure.
Figure 5:
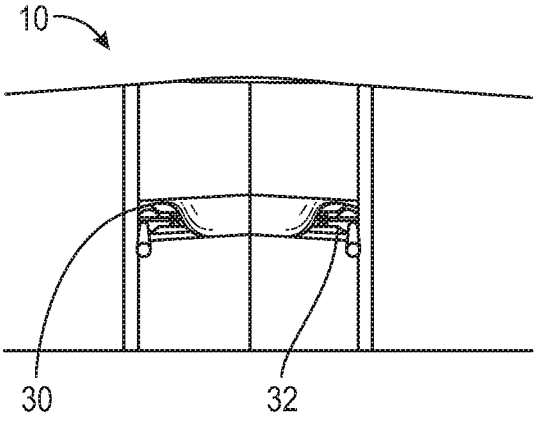
FIG. 5 is an enlarged view of a hinge of the spa cover, in accordance with the present disclosure.
Figure 6:
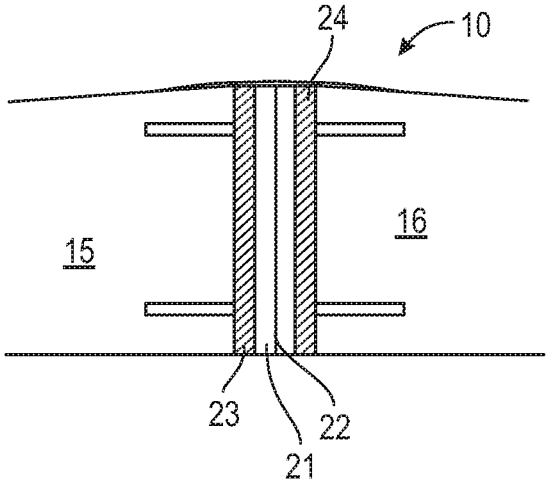
FIG. 6 is a cross-sectional view of the hinge, in accordance with the present disclosure.
Figure 7:
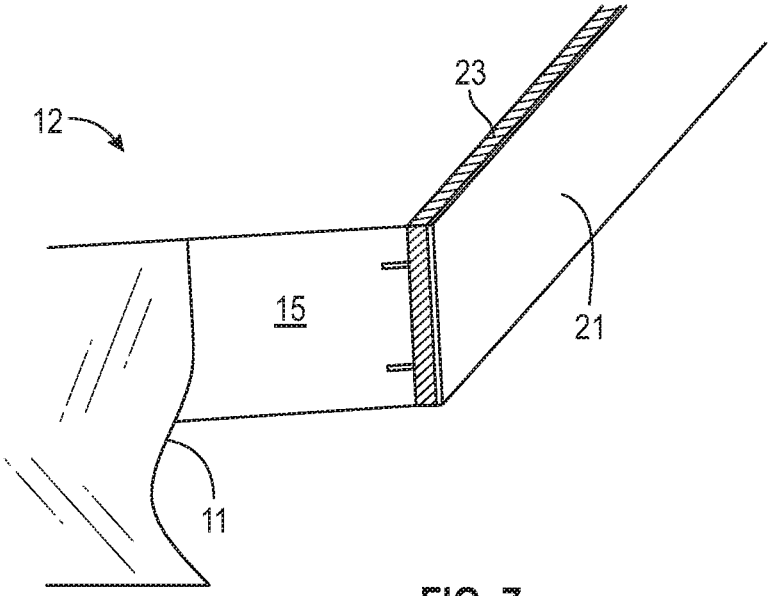
FIG. 7 is a partial cross-sectional view of an embodiment of the hinge
Figure 8:
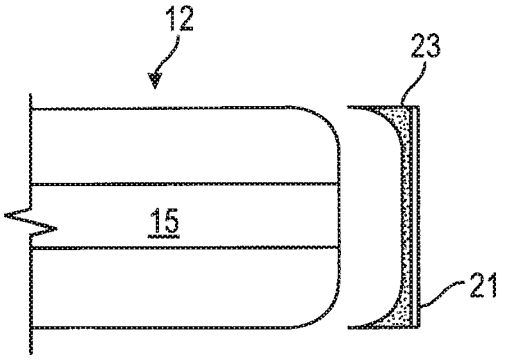
FIG. 8 is a partial cross-sectional and exploded view of a first side of the hinge, in accordance with the present disclosure.
Figure 9:
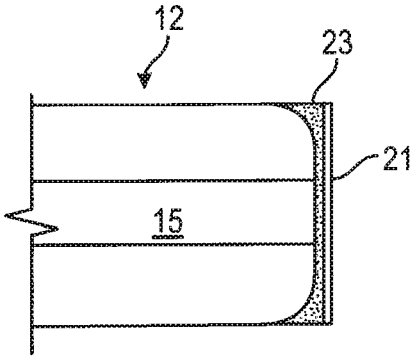
FIG. 9 is a partial cross-sectional view of the first side of the hinge, in accordance with the present disclosure.
Figure 10:
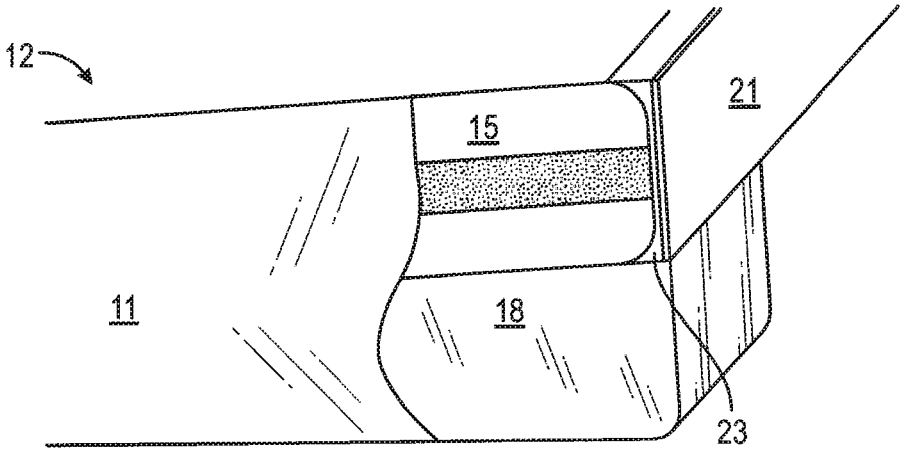
FIG. 10 is a partial cross-sectional view of a first portion of the spa cover, in accordance with the present disclosure.
Figure 11:
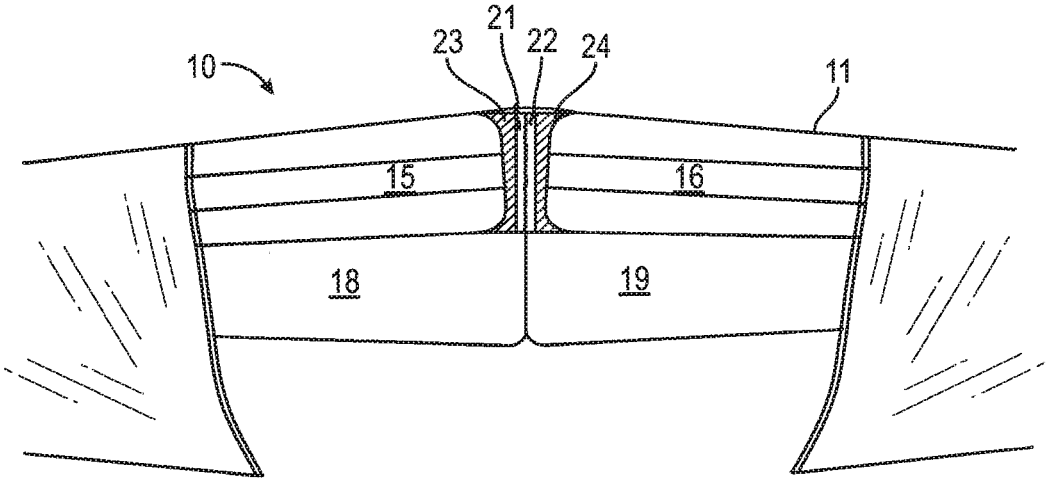
FIG. 11 is a partial cross-sectional view illustrating joining of both the first and second portions of the cover, in accordance with the present disclosure.
Figure 12:
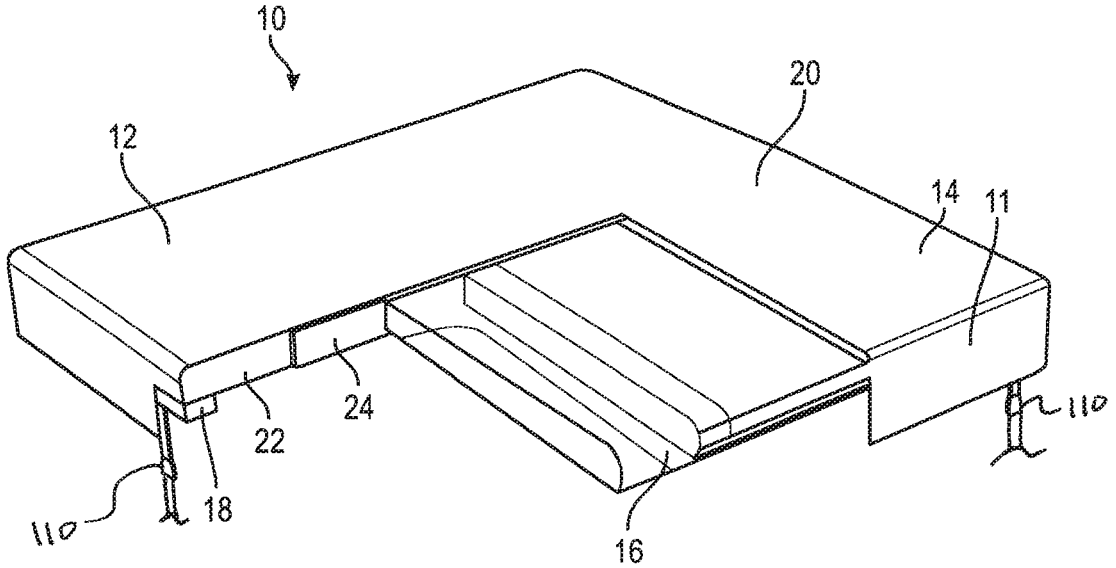
FIG. 12 is a partial cross-sectional perspective view illustrating components within the cover, in accordance with the present disclosure.
Figure 13:
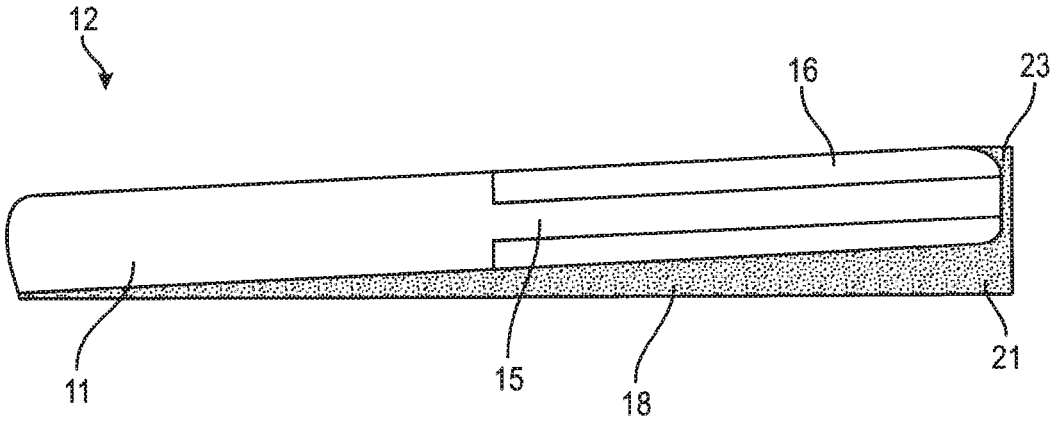
FIG. 13 is a cross-sectional side view of a first half of the cover, in accordance with the present disclosure.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Referring now to the drawings, wherein the depictions are for the purpose of illustrating certain exemplary embodiments only and not for the purpose of limiting the same, the figures show an exemplary spa cover 10. The cover 10 includes a first half 12 and a second half 14. The cover 10 includes an exterior sheet 11. This sheet 11 may be water proof or water resistant material or fiber such as vinyl. In one embodiment, the sheet 11 is sized to drape over an edge of the spa or hot tub i.e., as a skirt. The exterior sheet 11 may be one contiguous piece. In one embodiment, the sheet 11 includes a portion associated with the first halve 12, the second halve 14, and a hinge 20, which may then all be connected to one another such as by threading or the like.

The sheet 11 covers a first insulating portion 15 associated with the first half 12 and a second insulating portion 16 associated with the second half 14. The first and second insulating portions 15 and 16 may be formed of the same insulating material such as a drop stitch bladder. The sheet 11 is preferably connected to each of the insulating portions 15 and 16 using, for example, adhesive or bond. A side of each of the insulating portions 15 and 16 is connected to a separate elongated insulating gasket 23 and 24, respectively, which may be closed cell foam. The insulating gasket 23 and 24 may be half hourglass-shaped in cross section as seen in exemplary FIGS. 8-11. The insulating gasket 23 and 24 may be formed of a resilient material, in one embodiment. The insulating gasket 23 and 24 on each side of the hinge 20 are each connected to a thermal gasket 21 and 22, respectively. The thermal gaskets 21 and 22 are not connected to one another and are separable when the hinge 20 pivots open. Each of the thermal gaskets 21 and 22 may be formed of a neoprene rubber or like material. In one embodiment, the thermal gaskets 21 and 22 are each adhered to a surface of one of the insulating gaskets 23 and 24, e.g., gasket 23 is adhered to gasket 21 and gasket 24 is adhered to gasket 22.

The gaskets 21 and 22 can be made of a rubber material, such as a foam rubber such as open cell foam or a closed cell foam (e.g., neoprene polyurethane, polyethylene, or a deformable PVC). However, the disclosure is not limited in this respect, and the gaskets 21 and 22 may be made of a different resilient material as known in the art.

In one embodiment the insulating portions 15 and 16 may be formed of drop-stitch fabric. Drop-stitch fabric may be woven from polyethylene terephthalate or nylon thread. It is not stitched, although it appears to be stitched, hence the name "drop-stitch." It can be found that each thread used in the weaving process is woven several times in the warp direction, then up (or down) forming the "drop-stitch," and then several times in the weft direction before running down (or up) again. In various embodiments, the drop stitch fabric forms an outer surface of the bladder, while an insulating foam or other material forms a center.

The hinge 20 separates the first and second halves 12 and 14, respectively. The hinge 20 connects the two halves 12 and 14 and allows the spa cover 10 to be folded, if desired. The hinge 20 may be integral with the surface of the halves 12 and 14 and formed of a sheet or layer of a water proof or water-resistant material such as vinyl or the like. In one embodiment, the hinge 20 is formed of an elongated sheet that is threaded or otherwise connected to the halves 12 and 14.

Water-resistant acrylic or silicon-based adhesives may be used, although this disclosure is not to be limited by the particular type of adhesive used to secure components to one another in the manner described hereinabove.

FIGS. 1-5 show a zipper 30 and 32. In various embodiments, the first half 12 includes the first insulating portion 15, the first insulating gasket 23, and the first thermal gaskets 21 covered in a thermal sheet. The thermal sheet may be closed via the zipper 30. Likewise, the second half 14, which includes the second insulating portion 16, the second insulating gasket 24, and the second thermal gasket 22 may be wrapped in a thermal sheet and closed via a zipper 32.

As shown in FIGS. 1-3, 10-13, in one embodiment, a tapered gasket 18 and 19 may be included below the insulating portion 15 and 16, respectively. The tapered gasket 18 and 19 may be adhered to a bottom surface of the respective insulating portion 15 and 16.

In various embodiments, the first half 12 and the second half 14 may be separately hermetically sealed, with the tapered gasket 18 and 19 separately hermetically sealed below. The first half 12 may then be adhered to the first tapered gasket 18 or connected together with another hermetically sealed cover. The second half 14 may similarly hermetically sealed and then adhered to the second tapered gasket 19 or otherwise connected together with another hermetically sealed cover.

Figure 14:
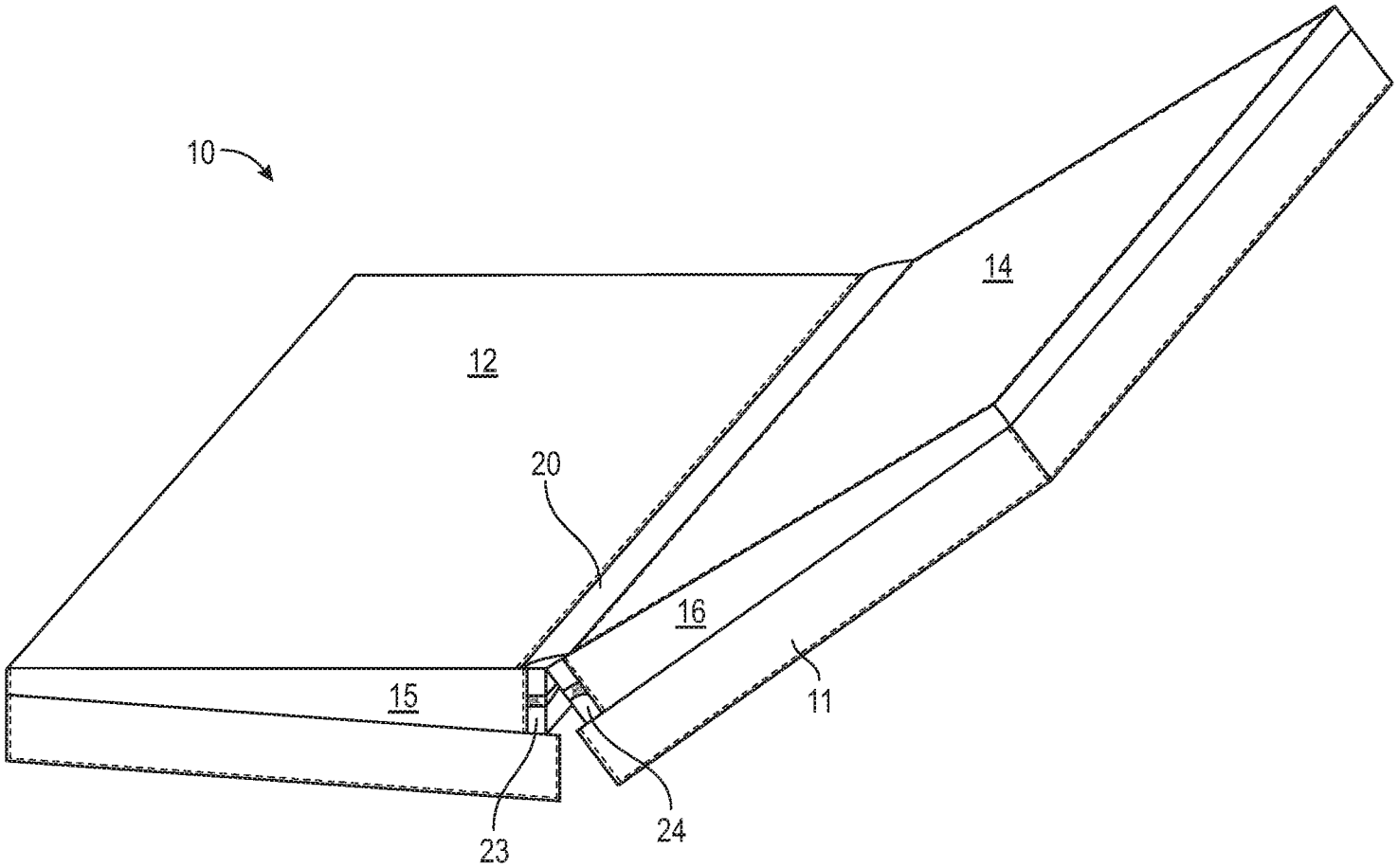
FIG. 14 shows a further embodiment of the spa cover, in accordance with the present disclosure.

FIG. 14 shows a further embodiment of the spa cover 10. As FIG. 14 shows, a side of each of the insulating portions 15 and 16 is connected to a separate elongated insulating gasket 23 and 24, respectively, which may be closed cell foam. The insulating gasket 23 and 24 may be formed of a resilient material, in one embodiment, so that when closed, the gaskets 23 and 24 compress against one another to form a "zero gap".

In various embodiments additional layers of thin waterproof layers can be used such as plastic materials. The use of layers of different materials within the cover 10 provides further moisture barriers without adding substantial thickness or weight. In one embodiment laminating thin layers together can be used to provide a moisture barrier.

Figure 15:
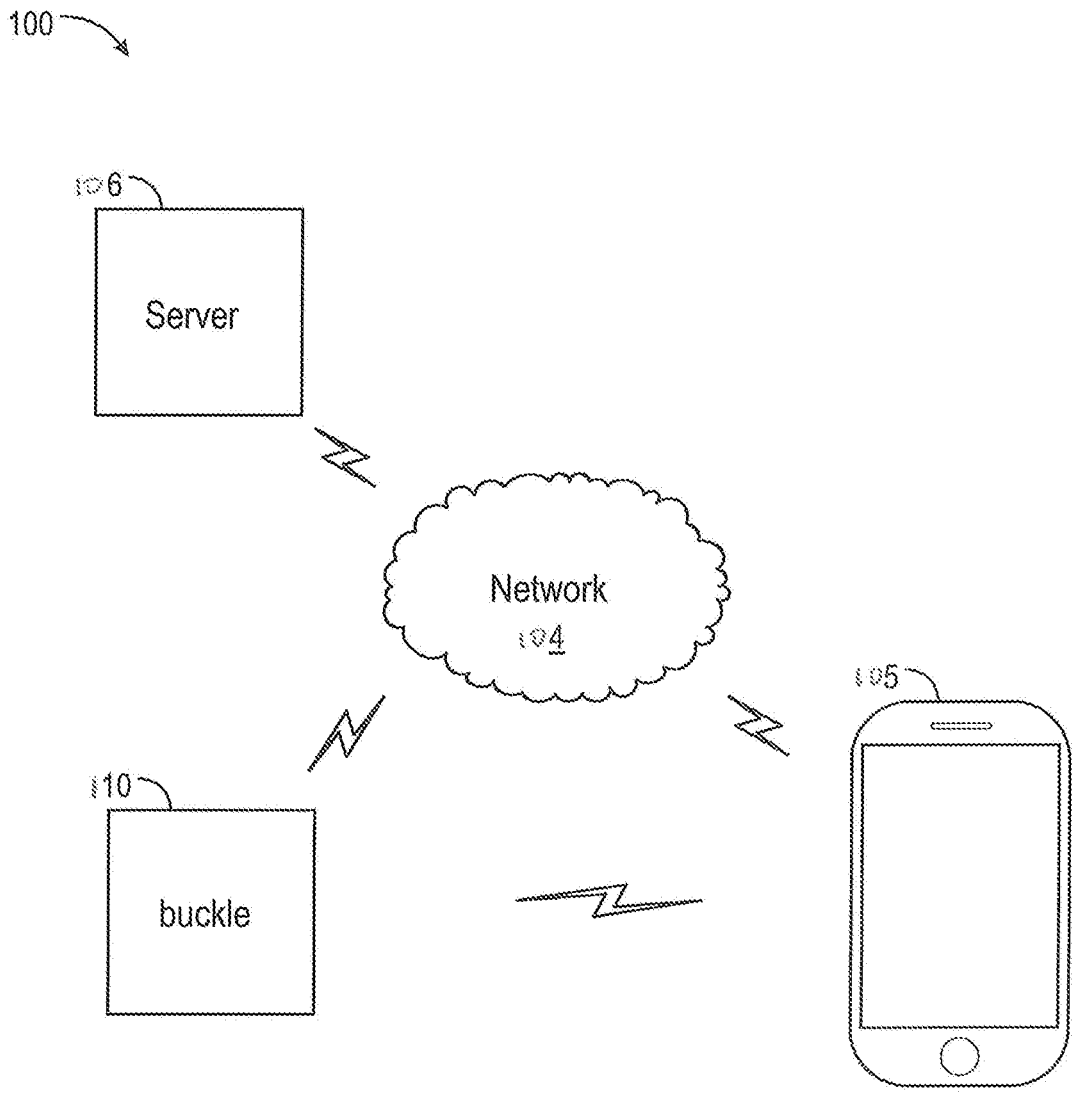
FIG. 15 schematically illustrates a buckle security system, in accordance with the present disclosure.

FIG. 15 schematically shows an exemplary buckle security system 100 that may help implement the methodologies of the present disclosure. The system 100 includes a mobile device 105, a server system 106, a network 104, and a buckle 110. As shown in FIG. 15, the buckle may be directly communicatively connected to the server system 106 and/or the mobile device 105 or connected via the network 104. The server system 106 and the mobile device 105 may be directly communicatively connected or connected via the network 104. The buckle 110 may be physically connected to the network 104 during selected periods of operation without departing from the teachings herein. Components of the system 100 are shown in FIG. 15 as single elements. Such illustration is for ease of description and it should be recognized that the system 100 may include multiple additional mobile and buckle devices.

The network 104 may be any suitable series of points or nodes interconnected by communication paths. The network 104 may be interconnected with other networks and contain sub networks network such as, for example, a publicly accessible distributed network like the Internet or other telecommunications networks (e.g., intranets, virtual nets, overlay networks and the like). The network 104 may facilitates the exchange of data between and among the buckle 110, the mobile device 105, and the server system 106.

The server system 106 may be: various embodiments of a computer including high-speed microcomputers, minicomputers, mainframes, and/or data storage devices. The server system 106 preferably executes database functions including storing and maintaining a database and processes requests from the buckle 110 and the mobile device 105 to extract data from, or update, a database as described herein below. The server 106 may additionally provide processing functions for the buckle 110 and the mobile device 105 as will become apparent to those skilled in the art upon a careful reading of the teachings herein.

In addition, the mobile device 105 may include one or more applications that the user may operate to control or monitor the buckle 110. Operation may include downloading, installing, turning on, unlocking, activating, or otherwise using the application. The application may comprise at least one of an algorithm, software, computer code, and/or the like, for example, mobile application software. In the alternative, the application may be a website accessible through the world wide web.

Figure 16:
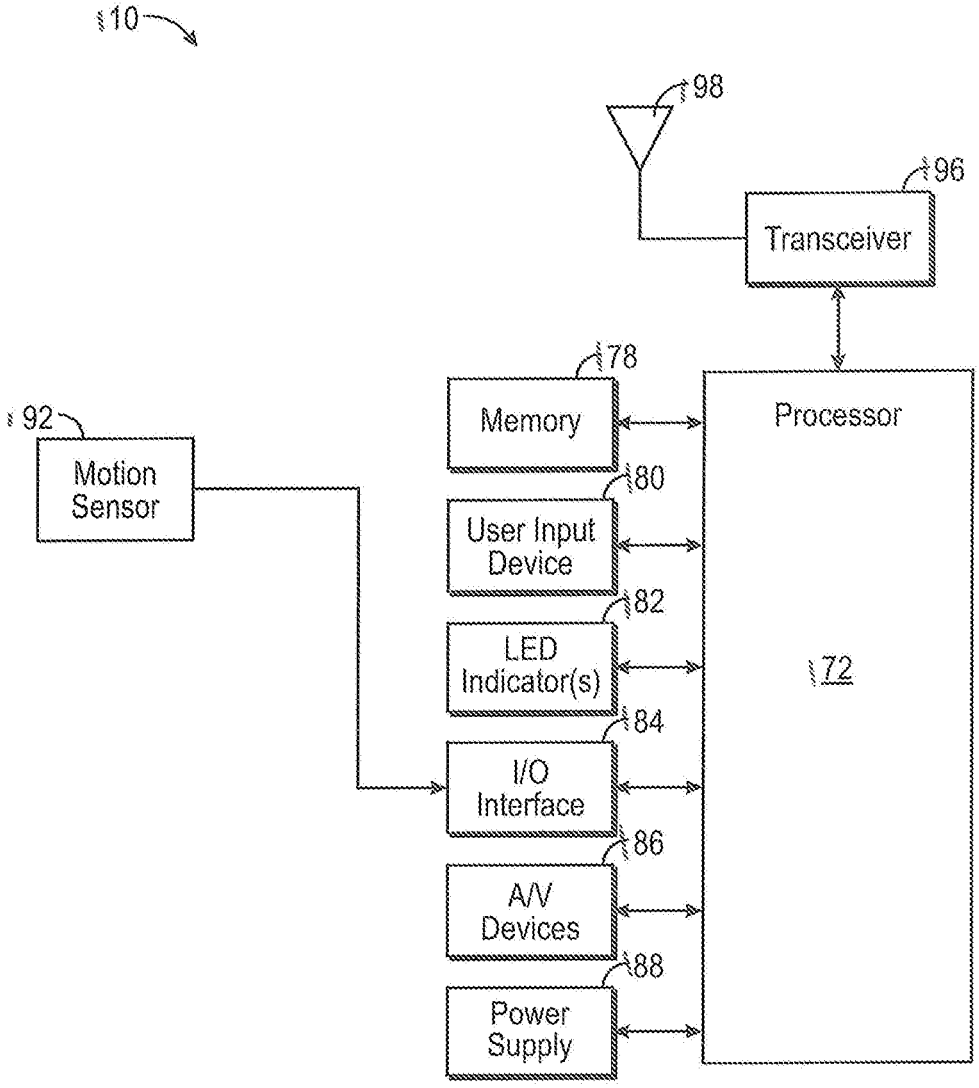
FIG. 16 schematically shows a control system of the exemplary buckle, in accordance with the present disclosure.

FIG. 16 schematically shows an exemplary embodiment of the buckle 110. As shown in FIG. 16, the buckle 110 includes a processor module 172. The buckle 110 may additionally include any digital and/or analog circuit elements, comprising discrete and/or solid state components, suitable for use with the embodiments disclosed herein. One skilled in the art will recognize upon a careful reading of the teachings herein that a radio processor may be included in another embodiment of the buckle 110. In one embodiment, a communication adapter and/or transceiver is utilized for wireless communication over one or more wireless communications channels. Although various components are shown as separate components, such an illustration is for ease of description and it should be recognized that the functions performed by the various components may be combined on one or more components.

The processor module 172 may be configured to execute various computer programs (e.g., software, firmware, or other code) such as application programs and system programs to provide computing and processing operations for the buckle 110. In various embodiments, processor module 172 may be implemented as a host central processing unit ("CPU") using any suitable processor or logic device, such as a general purpose processor, or other processing device in alternative embodiments configured to provide processing or computing resources to buckle 110. For example, processor module 172 may be responsible for executing various computer programs such as application programs and system programs to provide computing and processing operations for buckle 110. The computer programs may be stored as firmware on a memory associated with processor 172, may be loaded by a manufacturer during a process of manufacturing buckle 110, and may be updated from time to time with new versions or software updates via wired or wireless communication.

System programs assist in the running of a computer system. System programs may be directly responsible for controlling, integrating, and managing the individual hardware components of the computer system. Examples of system programs may include, for example, an operating system, a kernel, device drivers, programming tools, utility programs, software libraries, an application programming interface ("API"), a GUI, and so forth.

The memory module 178 is preferably coupled to the processor module 172. In various embodiments, the memory module 178 may be configured to store one or more computer programs to be executed by the processor module 172. The memory module 178 may be implemented using any machine-readable or computer-readable media capable of storing data such as volatile memory or non-volatile memory, removable or non-removable memory, erasable or non-erasable memory, writeable or re-writeable memory, and so forth. Although the memory module 178 is shown as being separate from the processor module 172 for purposes of illustration, in various embodiments some portion or the entire memory module 178 may be included on the same integrated circuit as the processor module 172. Alternatively, some portion or the entire memory module 178 may be disposed on an integrated circuit or other medium (e.g., solid state drive) external to the integrated circuit of the processor module 172.

A user input device 180 may be coupled to the processor module 172. The user input device 180 may include, for example, an alphanumeric, numeric key layout and an integrated number dial pad. The buckle 110 also may include various keys, buttons, and switches such as, for example, input keys, preset and programmable hot keys, left and right action buttons, a navigation button such as a multidirectional navigation button, power/end buttons, preset and programmable shortcut buttons, a volume rocker switch, a ringer on/off switch having a vibrate mode, a keypad and so forth. In one embodiment, the buckle 110 simply includes an ON and an OFF button, the other controls being activated through a wirelessly connected computing device, such as a workstation.

The processor module 172 may be coupled to one or more light-emitting diodes (LEDs) 182. In one embodiment, a first LED of the one or more LEDs is used to indicate a first status. In one embodiment, a second LED is used to indicate a second status. In one embodiment, the first status is associated with a green color and the second status is associated with a red color. In one embodiment, a third LED may be used to associate with a third status, e.g., a yellow color. Statuses may predefined as 'buckled'; 'not buckled', or 'low power.' In one embodiment, the LED 82 may be used simply to supply ambient light.

An I/O interface 184 is preferably coupled to the processor module 172. The I/O interface 184 may include one or more I/O devices such as a serial connection port, an infrared port, Blue Tooth Low Energy (BLE), Mesh Networks, wireless capability, and/or integrated 802.11x (WiFi) wireless capability, to enable wired (e.g., USB cable) and/or wireless connection to a local or networked computer system, such as the workstation 8, and/or the server 6.

In one embodiment, the buckle 110 includes an audio/video ("A/V") module 186 coupled to the processor module 172 for communicatively connecting and communicating therebetween to various audio/video devices. The A/V module 186 may be configured to support A/V capability of the buckle 110 including components such as, a microphone, one or more speakers, an audio port to connect an audio headset, an audio coder/decoder (codec), an audio player, a video codec, a video player, and so forth. The A/V input module 186 may include an imaging module configured to capture digital images. The imagining module may include an optical sensor, e.g., a charged coupled device (CCD) or a complementary metal-oxide semiconductor (CMOS) optical sensor to facilitate camera functions, such as recording photographs and video clips. The image frames may be processed by the memory 178 or displayed on the display 182.

A power supply 188 configured to supply and manage power to components of buckle 110 is preferably coupled to the processor module 172. In various exemplary embodiments, the power supply 188 may be implemented by a rechargeable battery, such as a removable and rechargeable lithium ion battery to provide direct current ("DC") power, and/or an alternating current ("AC") adapter to draw power from a standard AC main power supply. In one embodiment, the buckle 110 is connected to an exterior power supply.

The buckle 110 may include one or more transceivers 196 coupled to the processor 172 and an antenna 198, each transceiver may be configured to communicate using different types of protocol, e.g., Bluetooth®, Near Field Communications, Mesh network, etc., communication ranges, operating power requirements, RF sub-bands, information types (e.g., voice or data), use scenarios, applications, and so forth. For example, the transceiver 196 may include a Wi-Fi transceiver and a cellular or WAN transceiver configured to operate simultaneously. In various embodiments, the transceiver is alternated for a transmitter and/or receiver.

In one embodiment, the buckle 110 includes one or more sensors. The sensors may be directly coupled to the processor 172 or connected through one or more other modules including, e.g., the I/O interface, such as shown in FIG. 16. In one embodiment, an optical sensor 192 is included. In one embodiment, the optical sensor 192 is a motion detecting sensor or a proximity detecting sensor.

Figure 17:
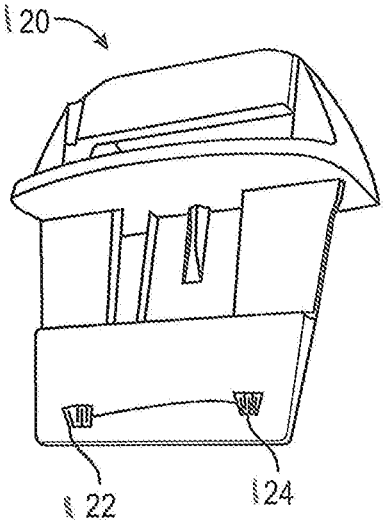
FIG. 17 shows an exemplary male connector of a buckle, in accordance with the present disclosure.

FIG. 17 shows a male buckle 120. The clip 120 is sized and adapted to be inserted into a corresponding female buckle 130 to form the buckle 110. In one embodiment, the male buckle 120 is configured to attach to a strap. In one embodiment, the male buckle 120 includes a first and a second electrical connection contacts 122 and 124, which are electronically connected. In this way, the female portion 130, when connected, can complete a circuit, indicating attachment of the male buckle 120 to the female buckle 130.

Figure 18:
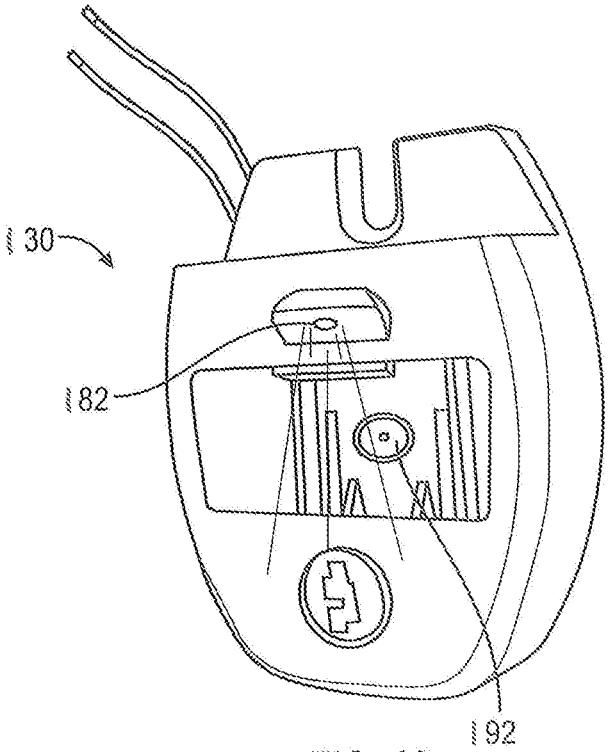
FIG. 18 shows an exemplary female connector of a buckle, in accordance with the present disclosure.
Figure 19:
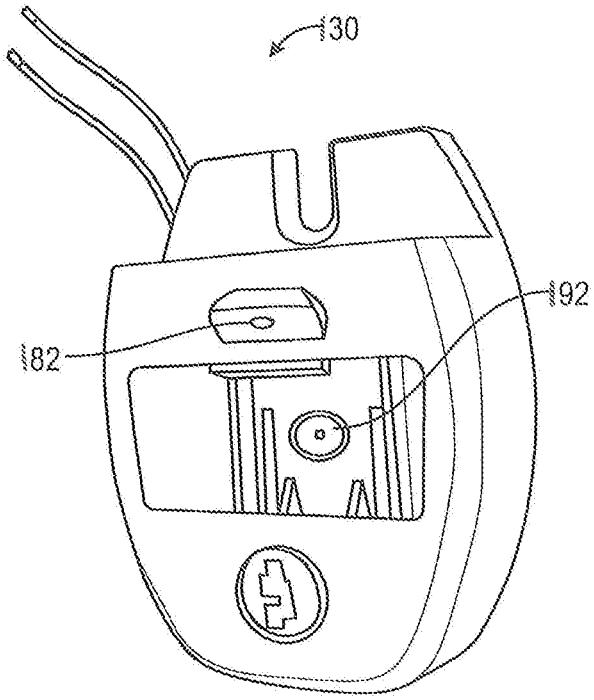
FIG. 19 shows another exemplary female connector of a buckle, in accordance with the present disclosure.

FIGS. 18 and 19 show the female buckle 130. As FIG. 18 shows, the LED 182 is at an ON operating state. As FIGS. 18 and 19 show, the female buckle 30 includes the led 182 and a sensor 192 positioned within the housing of the female buckle 130. In this way, the sensor 192 is positioned to detect whether a male buckle 120 is inserted within the female buckle 130. Upon detection, a signal may be transmitted. In various embodiments, the LED 182 may signal various conditions about the buckle 110, including, e.g., a READY operating state, LOW BATTERY operating state, SYNC operating state, etc.

In various embodiments push notifications can be sent to a user indicating status of the buckle 110. In one exemplary system having 'n' number of buckles, a notification may be sent based upon the number of buckles disconnected, and the time between detection among the various buckles. In one embodiment, a push notification is sent immediately after a first disconnect detection. In one embodiment, connected and disconnected status indicators of the buckle 110 may be transmitted to the mobile device 105 or the server 106. Connected and disconnected status may be defined as an event that initiates operating state transitions of the LED 182, in various embodiments.

In various embodiments, a plurality of buckles and interior spa lights may be instructed to synchronize lighting. For example, an ON operating state transition may be transmitted to one device such as a first buckle 110, which thereby transmits an ON operating state to other buckles. Similarly, interior spa lights may be setup to receive an operating state transition instruction and thereby transmit a similar or opposite instruction to other lighting devices such as the buckle 110. For example, some users may desire interior spa lights to be OFF when the buckle LEDs are ON.

In one embodiment, the buckle 110 includes the proximity detection sensor, which is an electrical circuit, completed when the male and female portions are coupled and is an open electrical circuit when the male and female portions are decoupled. In this way, an electrical potential is generated when connected, the absence of which when decoupled is an event causing transmission of information indicating the buckle is disconnected.

As used herein, the phrase "at least one of", when used with a list of items, means different combinations of one or more of the listed items may be used and only one of the items in the list may be needed. The item may be a particular object, thing, or category. In other words, "at least one of means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

While the foregoing disclosure discusses illustrative embodiments, it should be noted that various changes and modifications could be made herein without departing from the scope of the described embodiments as defined by the appended claims. Accordingly, the described embodiments are intended to embrace all such alterations, modifications and variations that fall within scope of the appended claims. Furthermore, although elements of the described embodiments may be described or claimed in the singular, the plural is contemplated unless limitation to the singular is explicitly stated. Additionally, all or a portion of any embodiment may be utilized with all or a portion of any other embodiments, unless stated otherwise.

The invention claimed is:

1. A spa cover, comprising:

a first half and a second half, each separate and symmetrical, and each comprising an insulating portion, a half hourglass cross-sectional-shaped insulating gasket, a resilient thermal gasket, and a tapered gasket spanning a bottom surface thereof;

a sheet covering both halves; and wherein the two separate and symmetrical halves are joined by a hinge.

2. The spa cover of claim 1, wherein the resilient thermal gasket has a rectangular cross-sectional shape and is coupled to a surface of the half hourglass cross-sectional-shaped insulating gasket.

3. The spa cover of claim 2, wherein the resilient thermal gasket of the first half and the second half separate when the spa cover is opened and abut each other when closed.

4. The spa cover of claim 1, wherein the insulating portion is formed of drop stitch bladder material.

5. The spa cover of claim 1, wherein the half hourglass cross-sectional-shaped insulating gasket is coupled to the insulating portion along each edge thereof and wherein the resilient thermal gasket is coupled to the half hourglass cross-sectional-shaped insulating gasket along a first side.

6. The spa cover of claim 1, wherein the hinge connects the first half to the second half allowing the spa cover to be folded.

7. The spa cover of claim 1, wherein the half hourglass cross-sectional-shaped insulating gasket is integral with the tapered gasket so that the insulating portion is coupled to a central position thereon.

8. A spa cover, comprising:

a first half and a second half, each separate and symmetrical, and each comprising an insulating portion, a half hourglass cross-sectional-shaped insulating gasket, a resilient thermal gasket, and a tapered gasket spanning a bottom surface thereof, wherein the half hourglass cross-sectional-shaped insulating gasket is coupled to an edge of the insulating portion proximate to the hinge and wherein the tapered gasket is adhered to a bottom surface of the insulating portion at a top portion of the tapered gasket;

a sheet covering both halves; and wherein the first half and the second half are joined by a hinge.

9. The spa cover of claim 8, wherein the resilient thermal gasket has a rectangular cross-sectional shape and is coupled to a surface of the half hourglass cross-sectional-shaped insulating gasket.

10. The spa cover of claim 9, wherein the resilient thermal gasket of the first half and the second half separate when the spa cover is opened and abut each other when closed.

11. The spa cover of claim 10, wherein the half hourglass cross-sectional-shaped insulating gasket is coupled to the insulating portion along all outer edges thereof and wherein the resilient thermal gasket is coupled to the half hourglass cross-sectional-shaped insulating gasket along a first side.

12. The spa cover of claim 11, wherein the half hourglass cross-sectional-shaped insulating gasket is integral with the tapered gasket so that the insulating portion is coupled to a central position thereon.

13. The spa cover of claim 9, wherein the insulating portion is formed of drop stitch bladder material.

14. The spa cover of claim 9, wherein the first half is hermetically sealed.

15. A spa cover, comprising:

a first half and a second half, each separate and symmetrical, and each comprising an insulating portion, a half hourglass cross-sectional-shaped insulating gasket, a resilient thermal gasket, and a tapered gasket spanning a bottom surface thereof, wherein the half hourglass cross-sectional-shaped insulating gasket is coupled to an edge of the insulating portion proximate to the hinge and wherein the tapered gasket is adhered to a bottom surface of the insulating portion at a top portion of the tapered gasket;

a sheet covering both halves;

wherein the first half and the second half are joined by a hinge; and a buckle, comprising:

a proximity detection sensor; and a transceiver configured to broadcast information corresponding to disconnection of the buckle.

16. The spa cover of claim 15, wherein the buckle further comprises a male portion and a female portion and wherein the transceiver is further configured to broadcast information corresponding to the male and female portion decoupling.

17. The spa cover of claim 16, wherein the proximity detection sensor is an electrical circuit, completed when the male and female portions are coupled and is an open electrical circuit when the male and female portions are decoupled.

18. The spa cover of claim 16, wherein the buckle further comprises:

one or more processors;

memory; and one or more programs, wherein the one or more programs are stored in the memory and configured to be executed by the one or more processors, the one or more programs including instructions for:

monitoring connection of the male and female portions;

determining whether the male and female portions are disconnected; and transmitting information based upon determining the male and female portions are disconnected.

* * * * *